United States Patent [19]

Molyneux

[11] 4,302,916

[45] Dec. 1, 1981

[54] DAMP-PROOF COURSES AND STRUCTURAL ASSEMBLIES INCLUDING DAMP-PROOF COURSES

[75] Inventor: George Molyneux, Plymouth, England

[73] Assignee: Radway Plastics Limited, West Midlands, England

[21] Appl. No.: 41,618

[22] Filed: May 23, 1979

[30] Foreign Application Priority Data

May 31, 1978 [GB] United Kingdom ..... 25159/78

[51] Int. Cl.[3] ..... E06B 1/26

[52] U.S. Cl. ..... 52/213; 52/62; 52/713

[58] Field of Search ..... 52/212, 204, 60–62, 52/396, 712–715, 213

[56] References Cited

U.S. PATENT DOCUMENTS 2,863,534 12/1958 Gillespie ..... 52/212
3,654,734 4/1972 Lehman ..... 52/212
3,922,826 12/1975 Molyneux ..... 52/204

FOREIGN PATENT DOCUMENTS 694214 7/1953 United Kingdom ..... 52/204
1175231 12/1969 United Kingdom ..... 52/204
1284263 8/1972 United Kingdom ..... 52/204

*Primary Examiner*—Price C. Faw, Jr.
*Assistant Examiner*—Henry E. Raduazo
*Attorney, Agent, or Firm*—Norris & Bateman

[57] ABSTRACT

The invention is concerned with damp-proof courses which can be used at the end of a cavity wall of a building structure adjacent to a door or window frame. The invention provides a damp-proof course, which has a high degree of versatility in use. The damp-proof course in accordance with the invention comprises a strip of corrosion-resistant moisture impermeable material (and is preferably formed as a plastics extrusion) and its cross-section provides two web-like elements arranged at an acute angle in the range 45° to 90° with respect to each other the first web having at least one undercut formation on the inside of the angle and the second web having at least one undercut formation on the outside, each of the undercut formations providing anchorage for wall ties at any position along the length of the strip, and at least one of the webs also has a moisture barrier formation on its inside extending throughout the length of the strip.

14 Claims, 17 Drawing Figures

DAMP-PROOF COURSES AND STRUCTURAL ASSEMBLIES INCLUDING DAMP-PROOF COURSES

Figure 1:
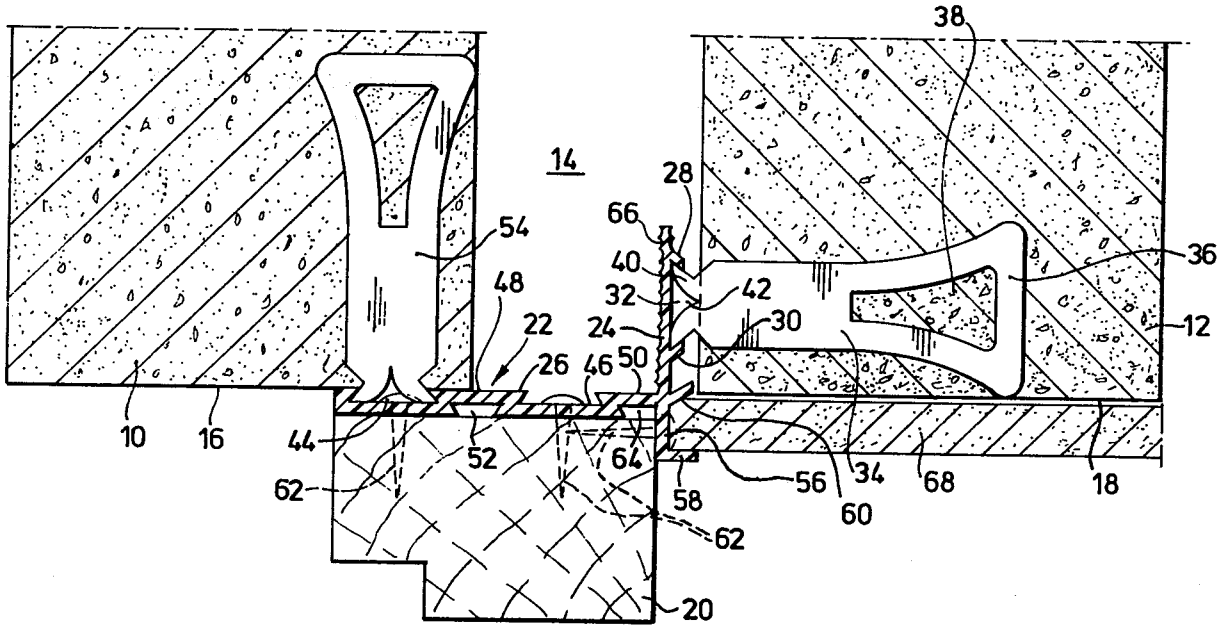

The present invention is concerned with damp-proof courses which can be used at the end of a cavity wall of a building structure adjacent to a door or window frame. In the Specifications of United Kingdom Pat. Nos. 1,302,694; 1,302,695 and 1,302,696, there is disclosed a damp course for use at the end of a cavity wall which abuts a side of a door or window frame, and which provides the damp course projecting into the cavity, which is essential at this part of the building structure, and at the same time provides a damp course separating the window or door frame from the brickwork of the wall itself. Furthermore, the damp courses described in the said United Kingdom Patent Specifications provide various other advantages, such as moisture barriers, and means for tying the two leaves of the cavity together, at a point in the structure, where the wall is sometimes rather weak.

It is the object of the present invention, to provide a damp-proof course which can be used in similar situations to those envisaged in United Kingdom Patent Specifications Nos. 1,302,694; 1,302,695 and 1,302,696, whilst offering a greater degree of versatility of use, than most of the damp-proof course members described in the said United Kingdom Patent Specifications. The invention also includes within its scope, structural assemblies, incorporating damp-proof courses in accordance with the invention.

According to this invention, a damp-proof course for use at the end of a cavity wall of a building structure which abuts the frame of a door or window, comprises a strip of corrosion-resistant, moisture impermeable material having a constant cross-section throughout its length, and providing two web-like elements arranged at an acute angle in the range 45° to 90° with respect to each other, a first of the two webs having at least one undercut formation on the inside of the angle formed by the two webs and the second web having at least one undercut formation on the outside, each of the undercut formations providing anchorage for wall ties and/or mortar and/or plaster at any position along the length of the strip, at least one of the webs also having a moisture barrier formation on its inside and extending throughout the length of the strip.

According to a preferred feature of the invention, one of the webs is longer than the other, as seen in cross-section of the strip. In one construction, each web has undercut formations in the outside, there being a larger number of these on the longer web than on the shorter web.

Preferably all the undercut formations are identical in shape, and they may also be identical in size. It is preferred to form them as undercut recesses, and in the preferred construction, they are of dovetail-shaped cross-section.

The fact that the undercut formations are all of the same shape and size, lends itself to the employment of separately moulded plastics tie bars, having root portions, which are adapted to fit into the undercut formations. Wall ties having root portions suitable for fitting into dovetail-shaped cross-section recesses, are disclosed in the Specification of United Kingdom Pat. No. 1,302,694.

In one construction, there is a socket formation on the outside of the angle formed by the webs, the socket being adapted to receive the end of a board which extends generally in the same direction as one of the webs. Such a socket formation may have an inwardly tapering cross-section whereby boards of different thickness can be engaged in it and will penetrate the socket to depths related to the thickness of the board. The outer extremity of the socket formation may be formed with a nose cross-section which is adapted to form a finishing mould (such as a quadrant mould) between the strip and a board fitted into the socket.

The moisture barrier formation may comprise one or more sharp edges each produced by converging faces, the said converging faces and resultant sharp edges extending throughout the length of the strip. The moisture barrier formation may comprise an undercut recess, such as a dovetail-shaped recess (as seen in cross-section) or it may comprise a plurality of shallow grooves in close juxtaposition to each other.

In a simple form, the strip comprises a first web having two undercut recesses on its inside face, a second web extending substantially at right angles to the first web as seen in cross-section, the two webs together forming a location for locating the strip on an inside corner of one leaf of a cavity wall, with one of the webs extending into the cavity and the other lying against the end of the said leaf of the cavity wall, and an extension of one of the webs on the outside of the angle formed by the two webs, this extension providing a pocket open at one side to receive a board extending in continuation of the other of the webs, the said other web and the extension together forming a location for locating the strip on one edge of a frame. Preferably a moisture barrier formation, such as an undercut recess is formed in the outside face of the other web to provide a moisture trap between the other web and a frame offered up to it.

In an alternative construction, the two webs are disposed at an acute angle less than a right angle with respect to each other, as seen in cross-section of the strip, a corner location is formed at the junction of the two webs whereby the strip can be located on a corner of one of the leaves of a cavity wall, and the arrangement of the webs is such that the point of intersection of a projection of the outer end of either web along a perpendicular to the other web and that other web is less than 50 millimeters from the corner location. The significance of this feature of the invention is that in the United Kingdom, the width of the cavity in a cavity wall is not usually less than 50 millimeters, and consequently, if the corner location is used to locate the strip against the corner between the end of a wall leaf and the face of that leaf which is in the cavity, so that one web bridges the end of the cavity and rests against the end of the other leaf of the wall, and the other web extends into the cavity, that other web will not touch the inside face of the other leaf. Hence, there is no possibility of moisture travelling from one leaf to the other across the cavity entering web, but at the same time, the one web closes the end of the cavity.

One or both webs may be provided with an inwardly projecting location rib spaced from the corner location by a distance such that with the corner location located on the inside corner of one leaf of a cavity wall, the location rib will rest against the inside of the other leaf of the cavity wall. In this way, the two leaves of the cavity wall can be accurately aligned with each other, and with respect to the damp-proof course, and a window or door frame fixed to that damp-proof course. Preferably, the distance between the corner location and the opposite face of the inwardly projecting location rib, is 50 millimeters, so that the damp-proof course is specially adapted to be located in a cavity of 50 millimeters width. The location rib may be formed with a moisture barrier such as a plurality of closely juxtapositioned grooves, in one or both of its faces.

Alternatively, or in addition to the location rib, longitudinally extending markings may be provided on the inside face of either or both webs, to indicate the position of the inside face of the leaf of the wall, opposite to the leaf on which the corner location is located.

A diagonal strut may extend between the two webs to provide a brace against closure of the angle between the webs. This diagonal strut may be formed integrally with one or both of the webs, and it is preferably located adjacent to the joint between the two webs (i.e. its ends are not widely spaced from the joint). It is also preferred to provide a moisture barrier formation on the inside face of the strut (i.e. the face which is visible on the inside of the strip).

In a preferred arrangement, each web has an inwardly facing undercut formation adjacent to its outer extremity, one web has three outwardly facing undercut formations and the other has four outwardly facing undercut formations. It is preferred that the outwardly facing undercut formations one on each web nearest to the joint between the two webs are deeper than the other outwardly facing undercut formations. It is still further preferred that a small extension on the outside of the two webs near to the joint is formed with a narrow channel to receive the scrim of a plaster coating.

According to another preferred feature of the invention a kit for use in building construction comprises a damp-proof course strip as previously described and a stop element in the form of a strip of constant cross-section throughout its length the cross-sectional shape of the stop element providing it with a formation such that it can be located in an undercut formation in the damp-proof course strip. Preferably the stop element is so formed that it can be located in an undercut formation in either of two orientations, and it has a shoulder portion, which exhibits two oppositely facing abutments external to the damp-proof course strip when the stop element is in position on the damp-proof course strip, the shoulder portion being so arranged that the oppositely facing abutments occupy alternative locations relatively to the damp-proof course strip in the alternative orientations of the stop element.

According to yet another preferred feature of the invention a kit for use in building construction comprises a damp-proof course strip as previously described and a gap closing element comprising a strip of constant cross-section throughout its length adapted to be secured to a door or window frame and of a thickness equal to the thickness of one of the webs of the damp-proof course strip. The gap closing element preferably has a feather edge on the side opposite to that which is intended to abut the door or window frame.

Preferably the damp-proof course strip is formed as an extrusion in plastics material, such as polyvinylchloride, and the stop element and the gap closing element if these are provided, are preferably also formed as plastics extrusions. A kit may also include a plurality of wall ties, each formed with a root which is adapted to be anchored in one of the undercut formations in the damp-proof course.

Figure 2:
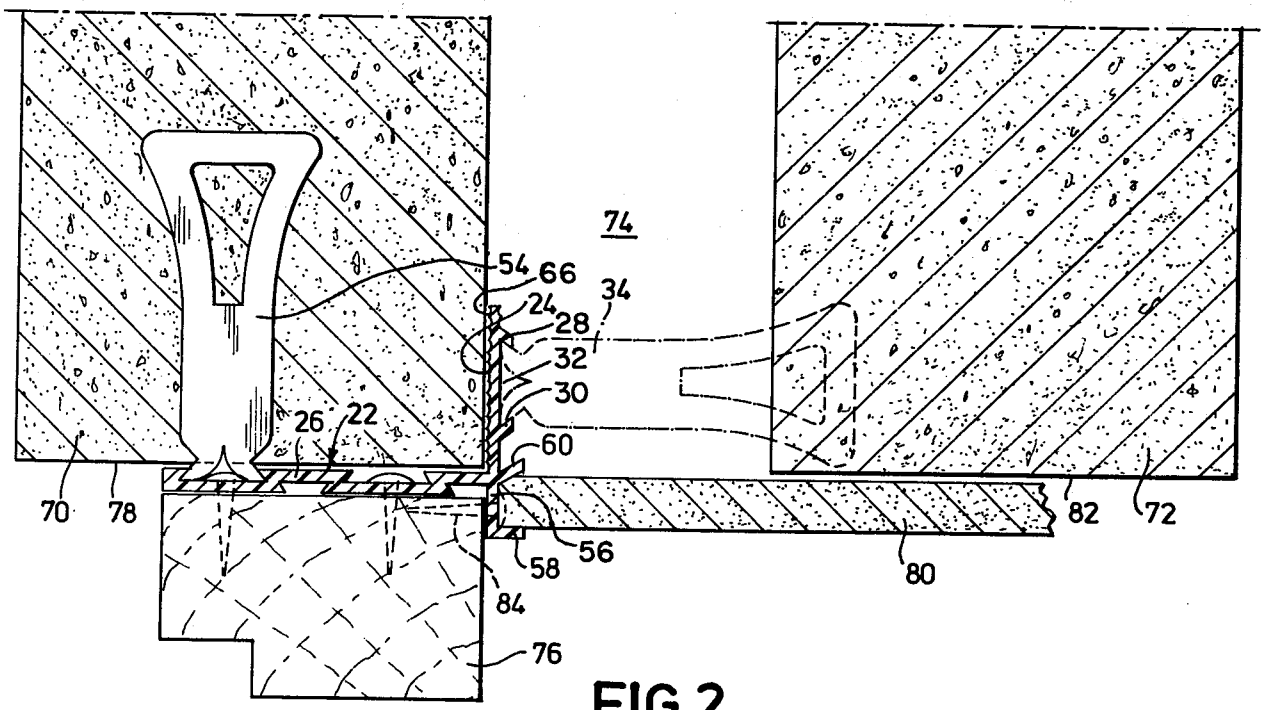
Figure 3:
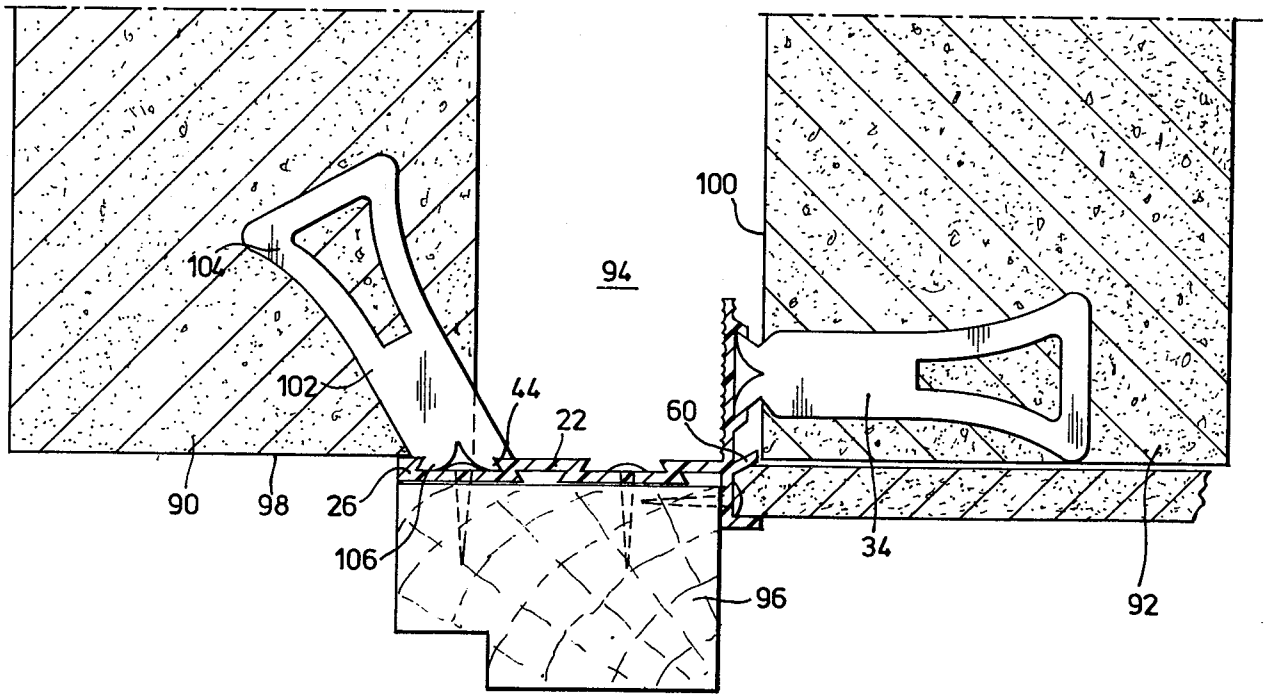
Figure 4:
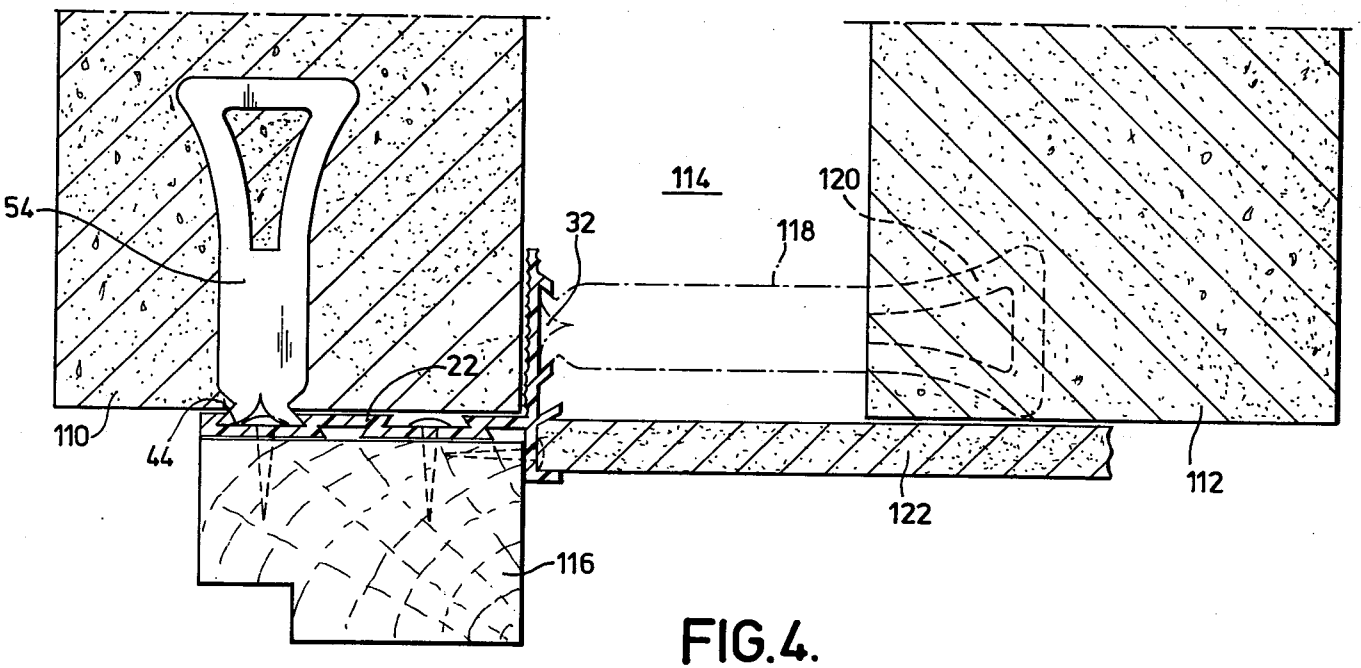
Figure 5:
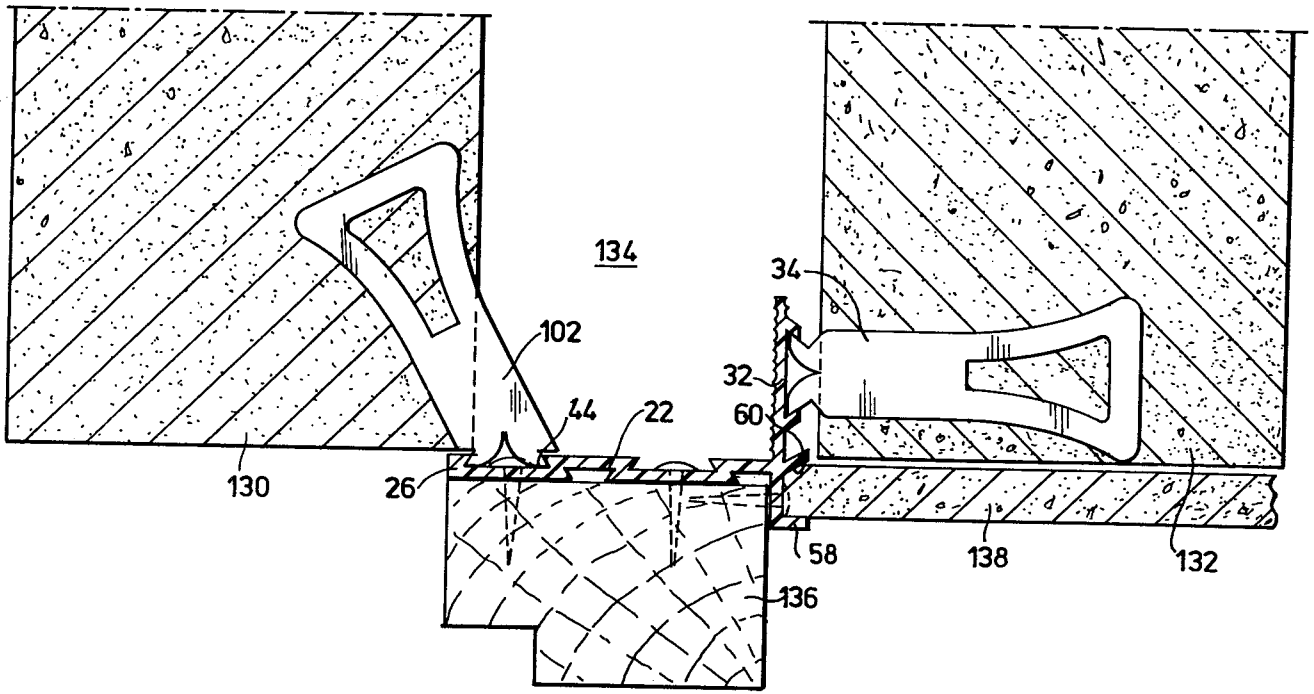
Figure 6:
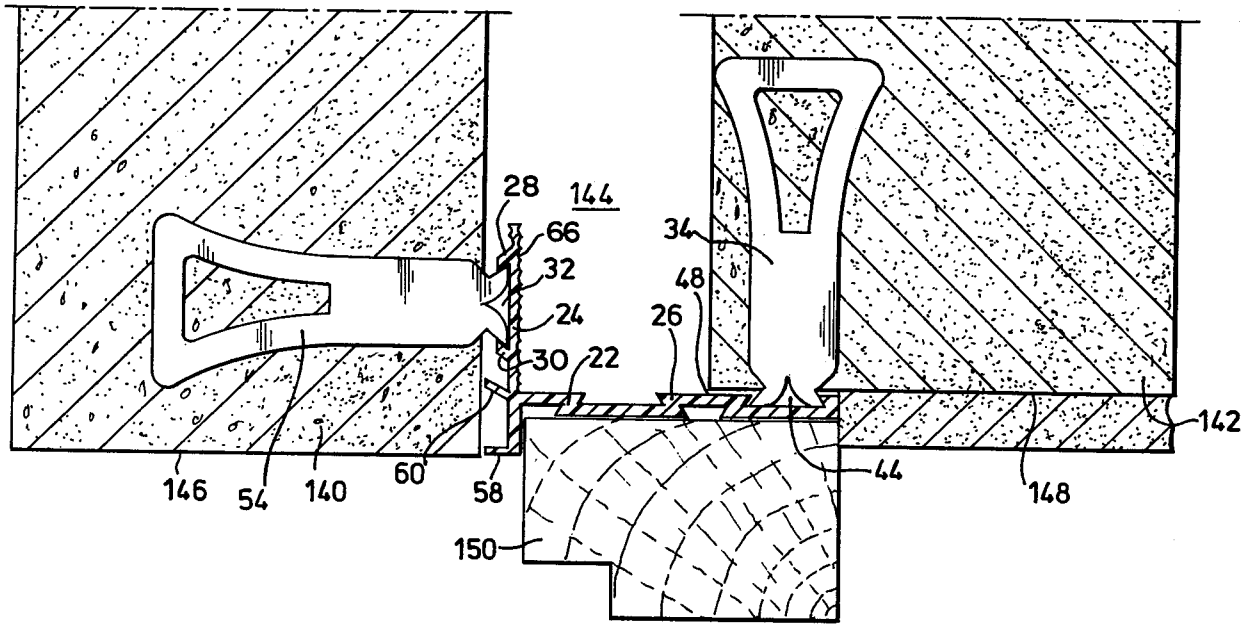
Figure 7:
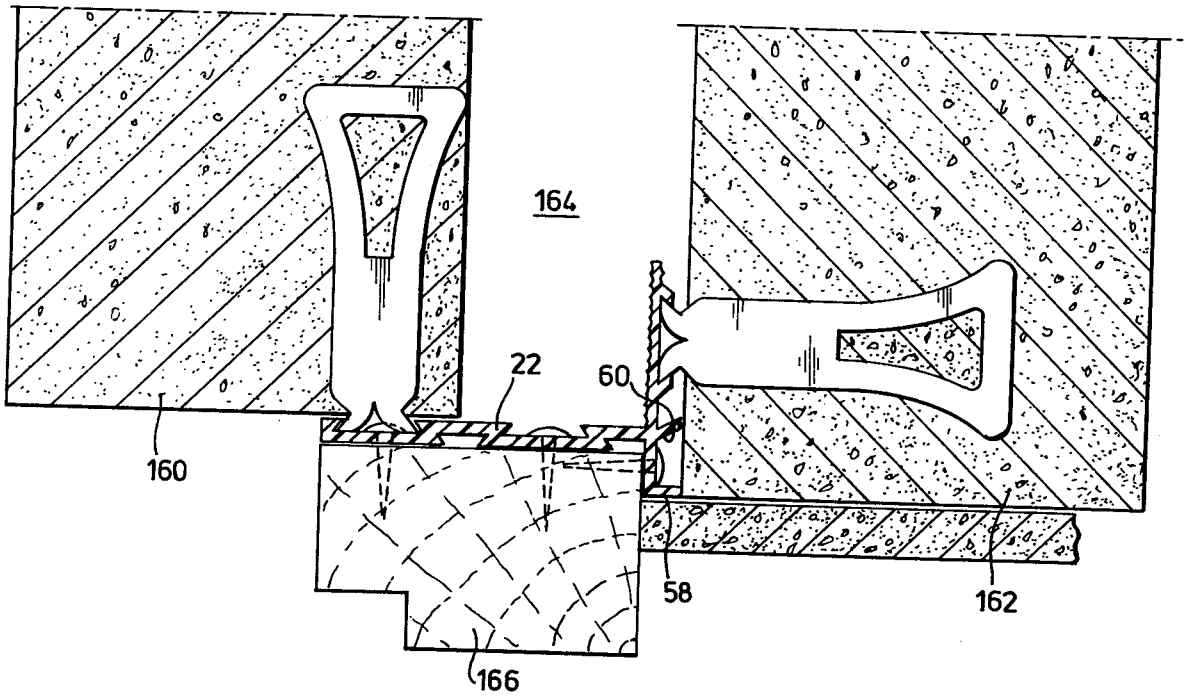
Figure 8:
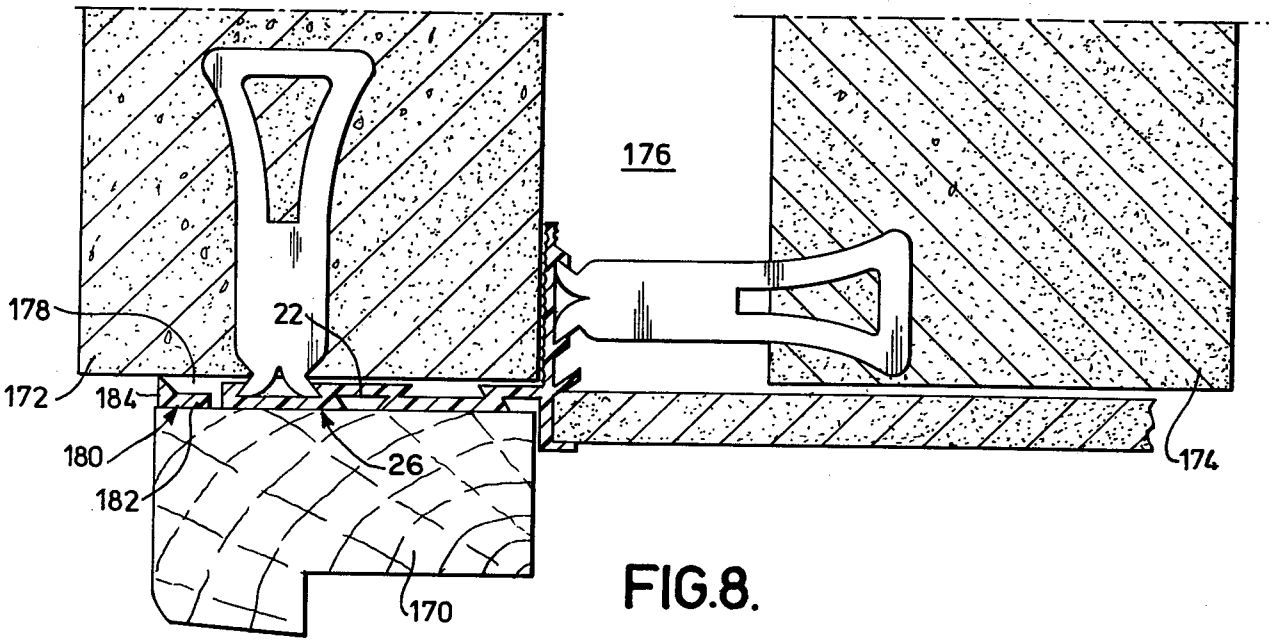
Figure 9:
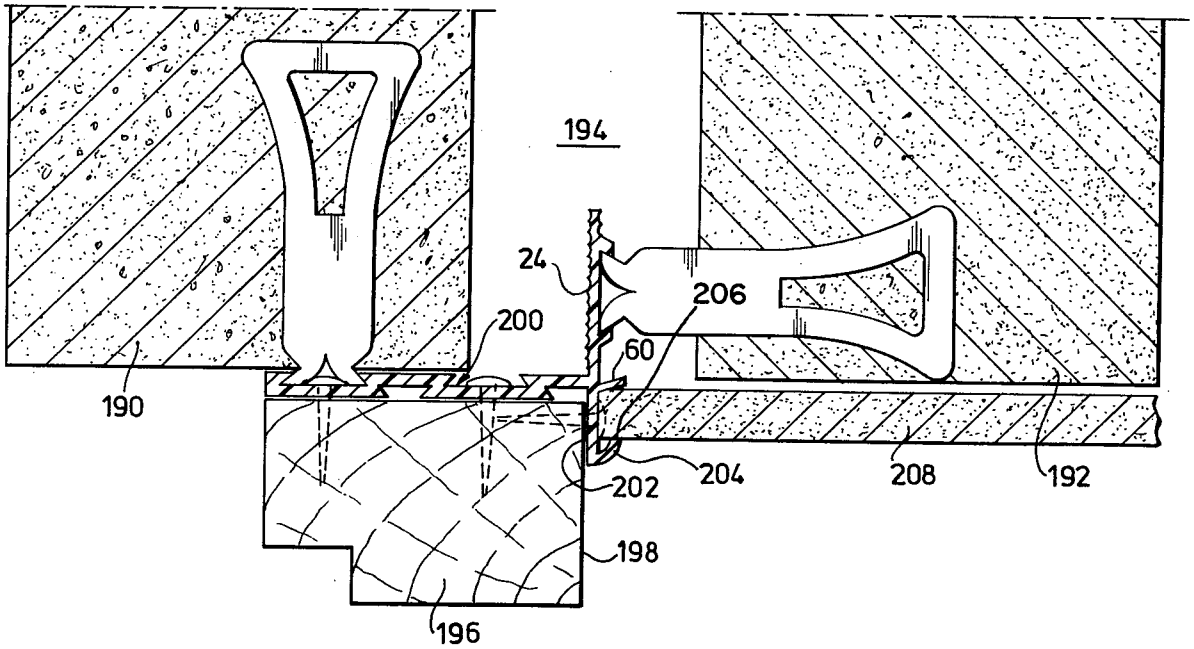
Figure 10:
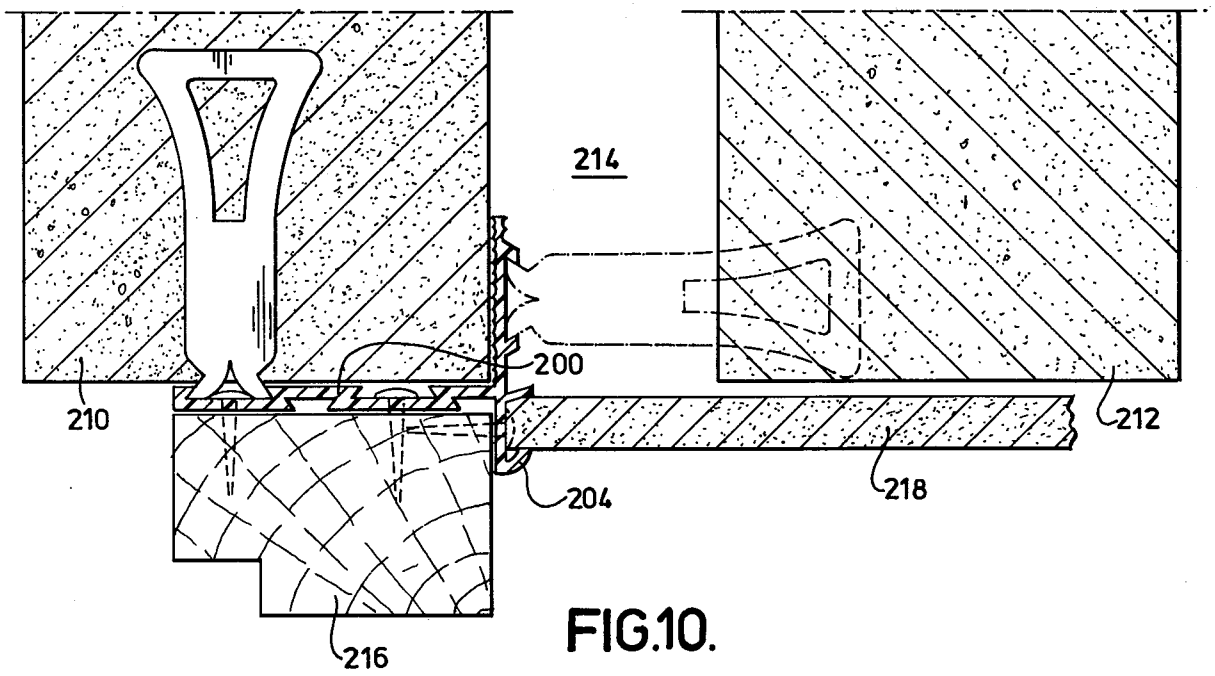
Figure 11:
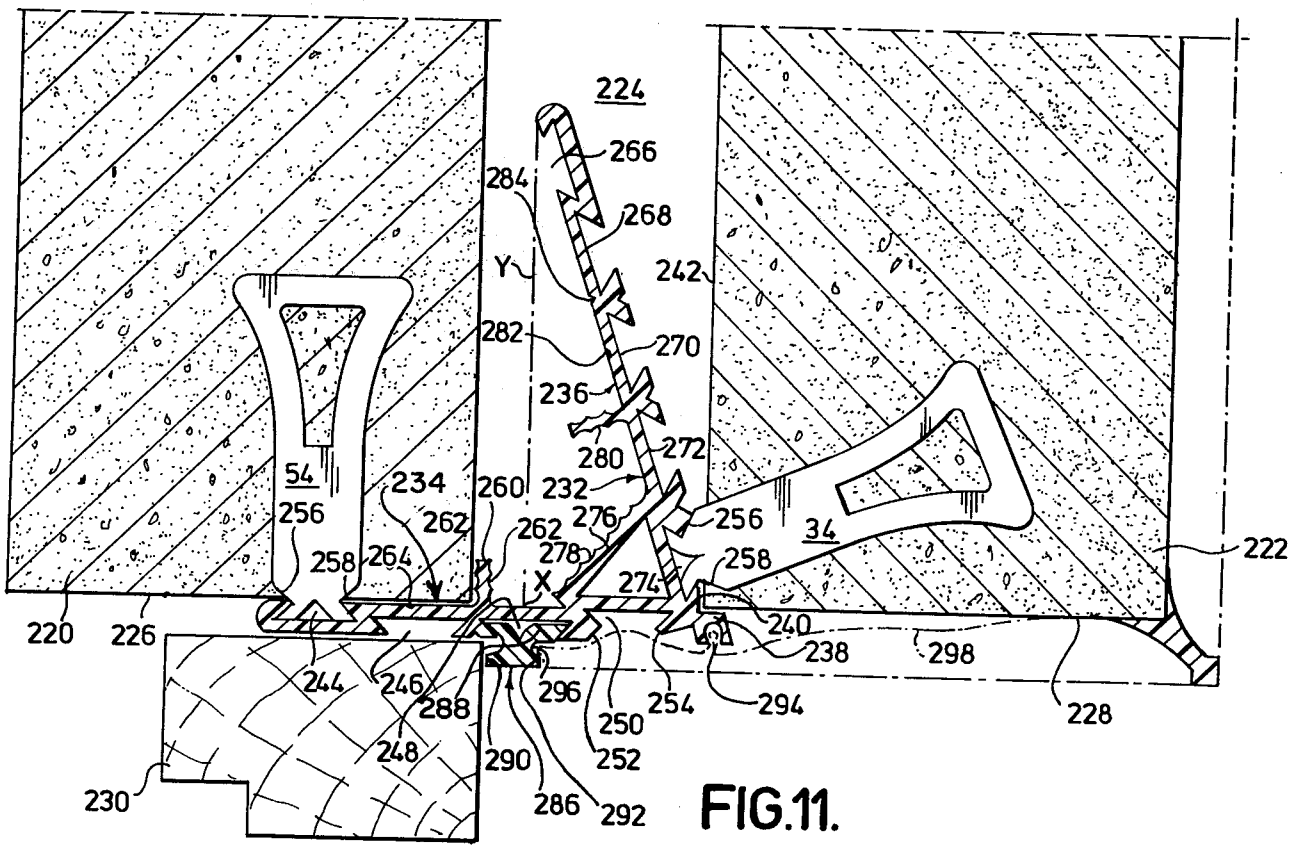
Figure 12:
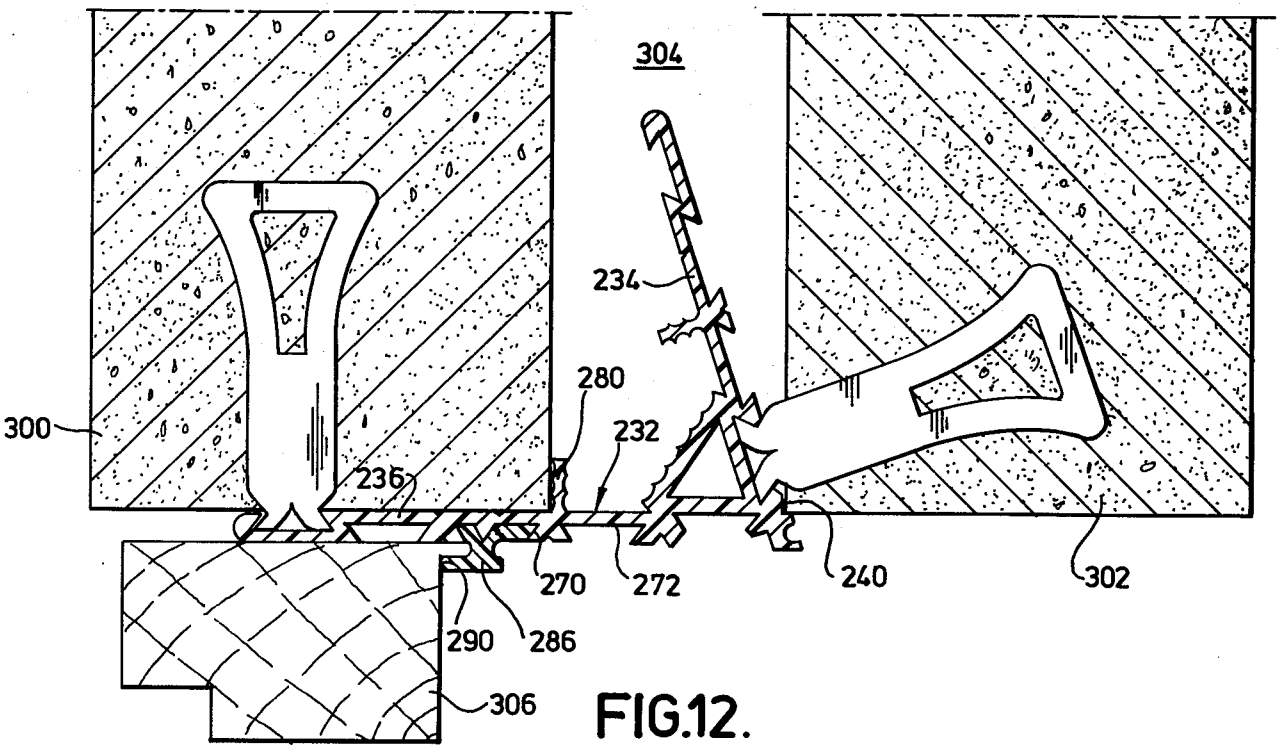
Figure 13:
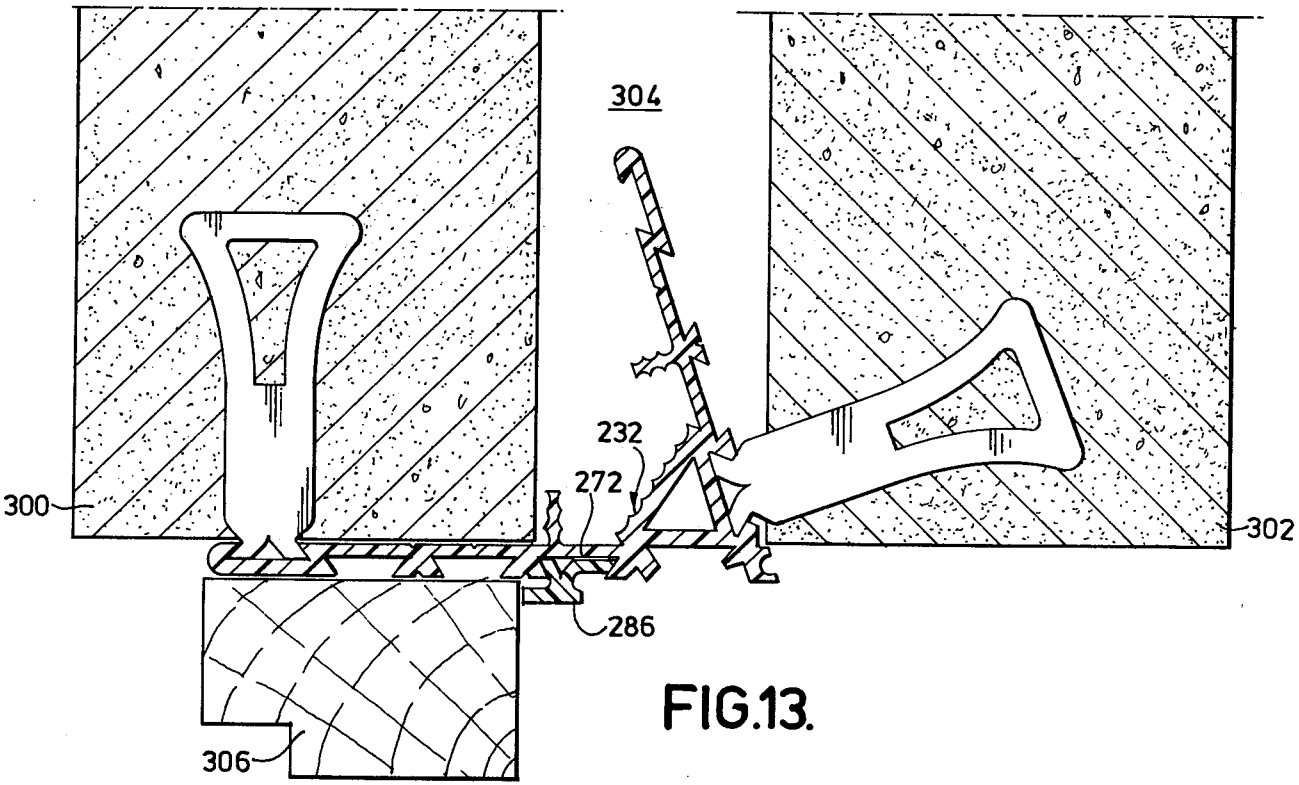
Figure 14:
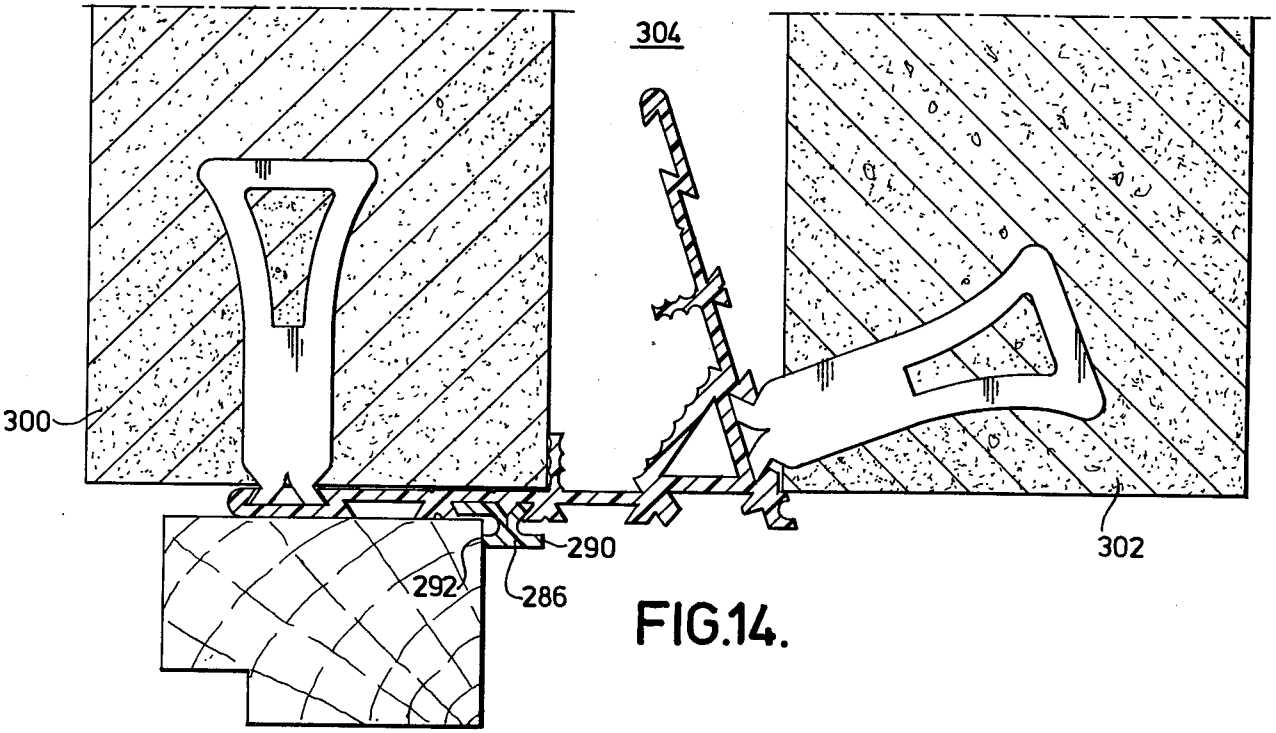
Figure 15:
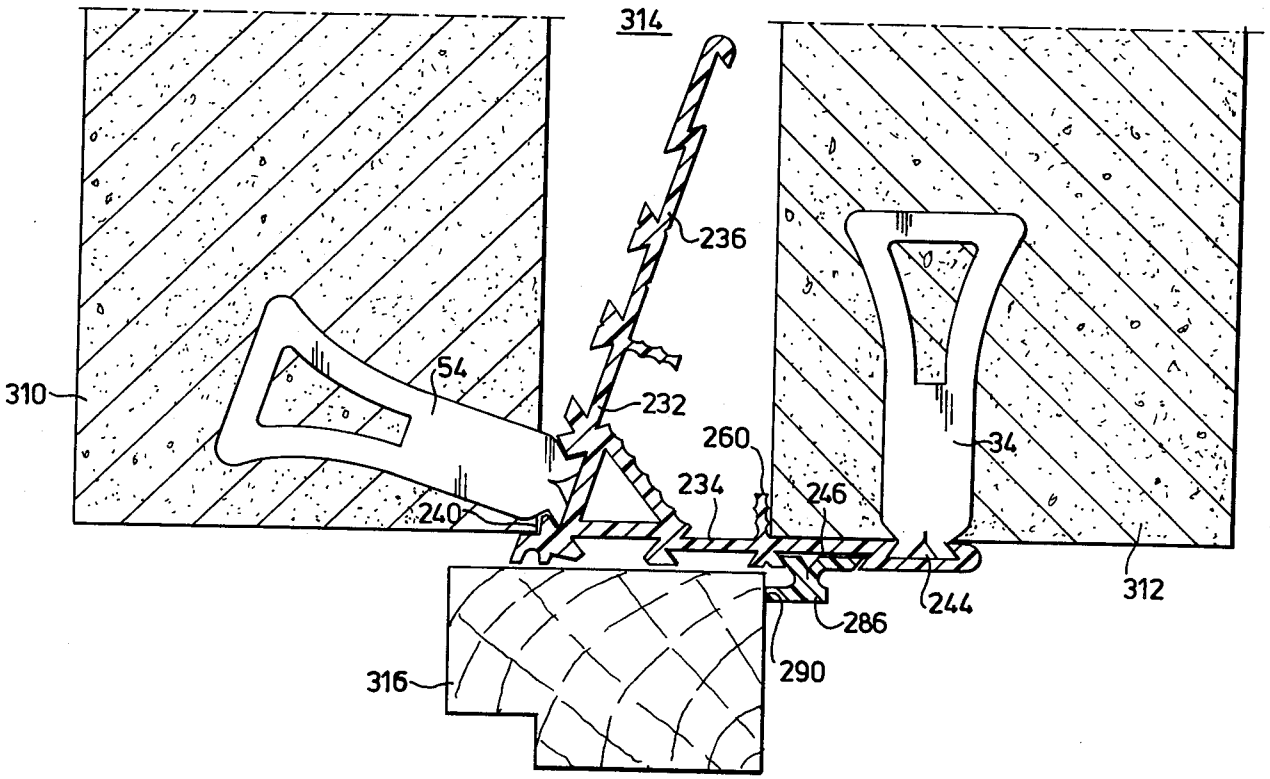
Figure 16:
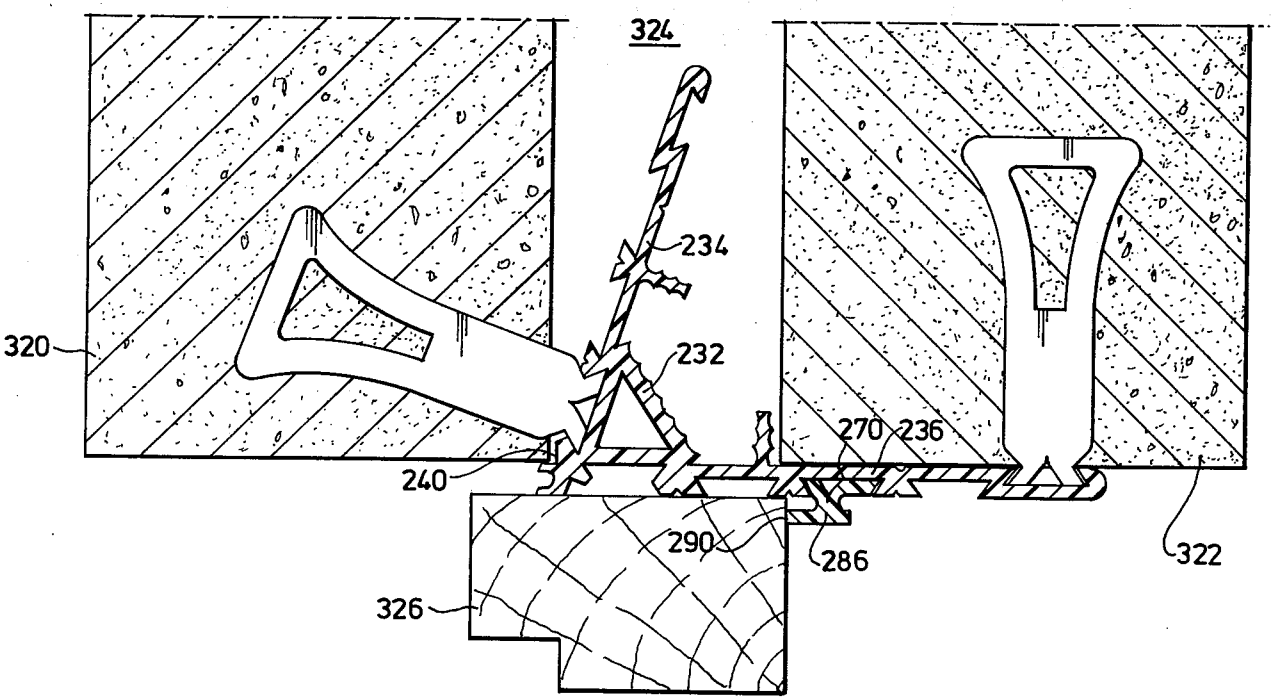
Figure 17:
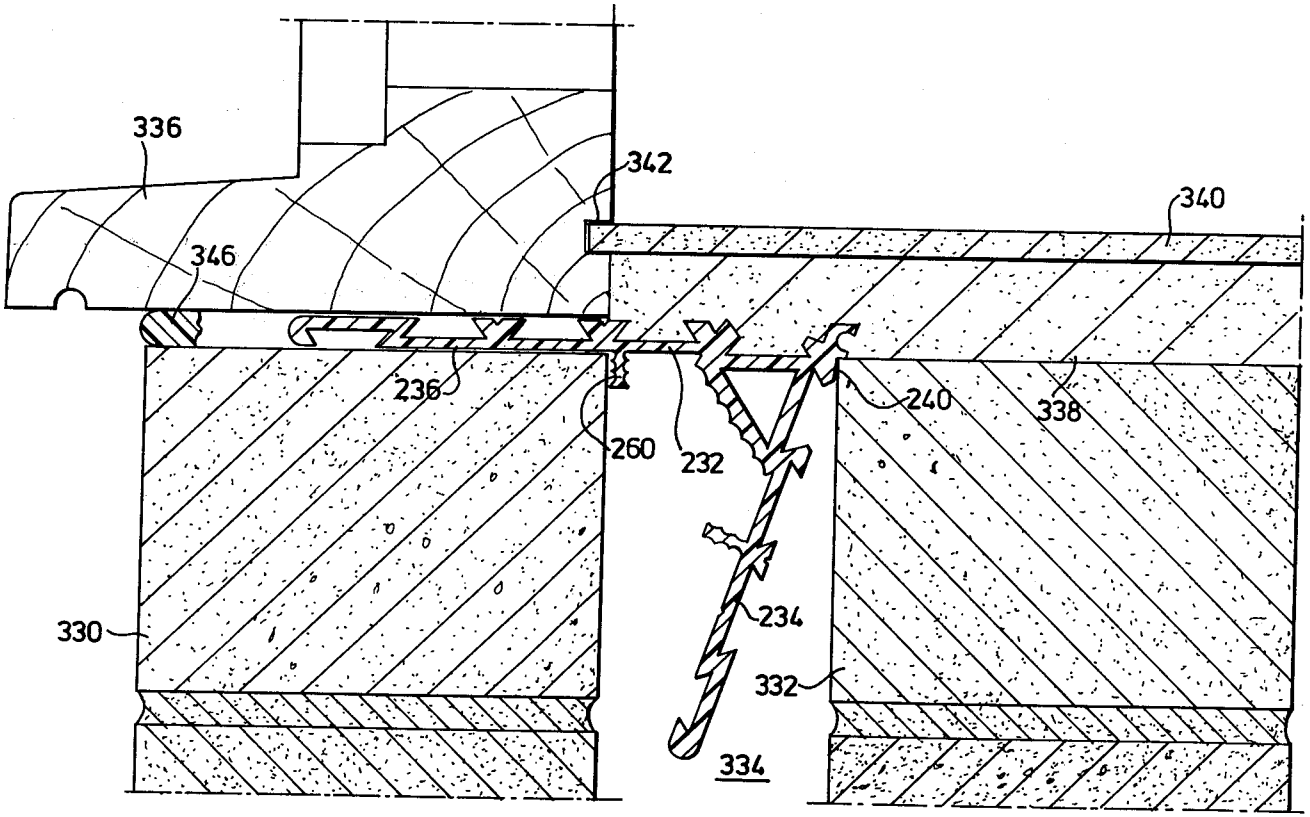

The invention also comprises various structural assemblies incorporating the damp-proof course, some of which will be apparent from the following description of various constructions, which are described by way of examples only, with reference to the accompanying drawings, in which:

FIG. 1 is a horizontal section through an end of a cavity wall and the jamb of a window frame, fitted to the end of the cavity wall, illustrating a simple form of damp-proof course element, FIG. 2 is a view similar to FIG. 1, but showing an alternative position of the window frame jamb, and damp-proof course element, FIG. 3 is a view similar to FIG. 1, but showing a wider cavity, FIG. 4 is a view similar to FIG. 1, but showing the window frame jamb mounted on the outer leaf of a wide cavity, FIG. 5 is a view similar to FIG. 4, but showing the window frame jamb bridging the end of the wide cavity, FIG. 6 is a view similar to FIG. 1, but showing a cavity wall with an internal checked reveal, FIG. 7 is a view similar to FIG. 1, but showing a cavity wall with an external checked reveal, FIG. 8 is a view similar to FIG. 1, but showing an alternative type of window frame, and the use of a gap closing element, FIG. 9 is a view similar to FIG. 1, but showing an alternative construction of damp-proof course element, FIG. 10 is a view similar to FIG. 9, but showing an alternative position for the damp-proof course element, FIG. 11 is a horizontal cross-section through the end of a cavity wall adjacent to a window or door frame opening, showing the use of a more sophisticated form of damp-proof course element, and a stop element, with a window or door frame positioned on the external leaf of the wall, FIG. 12 is a view similar to FIG. 11, but illustrating an alternative position of the window or door frame on the outside leaf of the wall, FIG. 13 is a view similar to FIG. 12, but illustrating an alternative position for a stop element, FIG. 14 is a view similar to FIG. 13, but illustrating another position for the stop element, FIG. 15 is a view similar to FIG. 11, but showing an alternative method of using the damp-proof course element, so that the window frame bridges the end of the cavity, FIG. 16 is a view similar to FIG. 15, but showing a further alternative way of using the damp-proof course element, in order to position the window frame across the end of the cavity, and FIG. 17 is a vertical section through a cavity wall immediately beneath a window frame, illustrating the use of a damp-proof course element in accordance with the invention beneath the window frame sill.

Referring to FIG. 1, there is illustrated the external leaf 10, and the internal leaf 12, of a cavity wall, having a cavity 14 between them, in this instance, the cavity being of approximately 50 millimeters width, that is the minimum width of cavity normally used in building construction in the United Kingdom. In this particular arrangement, the ends 16 and 18 of the leaves 10 and 12, are in alignment with each other, and this is the most commonly adopted arrangement, at an opening for a door or window frame. A jamb 20 of a standard 70 millimeters thickness window frame is illustrated in FIG. 1 and it will be observed, that the window frame is located so that it extends partly over the external leaf 10, and over most of the width of the cavity 14. In other words, the window frame is set fairly well back to the inside of the cavity wall, and this is often regarded as desirable, as it provides some protection for the window frame against rainfall.

For the purpose of securing the window frame in the cavity wall, and at the same time providing the necessary damp-proof courses, a special damp-proof course element 22 is provided, and this will now be described in some detail.

Basically, the element 22 is formed as an extrusion in polyvinylchlroride, or similar plastics material, which has the properties of being corrosion-resistant and moisture impermeable. By virtue of its impermeability, the element 22 is adapted to provide damp-proof courses which are at least as effective as the conventional bitumen impregnated felt damp-proof courses, conventionally used at the end of a cavity wall, adjacent to a door or window frame, and by virtue of its corrosion-resistance, the element 22 is adapted to provide a very long life element, conceivably exceeding the life of other structural features, such as the window or door frame itself. The fact that the element 22 is made by an extrusion process, makes the production of large quantities relatively cheap, and it also enables the element to be provided in the form of long strips, ready for cutting into the lengths required on any particular job.

Essentially, the damp-proof course element 22 comprises a short web 24, and a somewhat longer web 26, disposed at right angles to each other as seen in cross-section. The short web 24 is provided with a pair of inclined ribs 28 and 30 on its outside face, which between them define an undercut recess 32, of dovetail-shaped cross-section. As illustrated in FIG. 1, a special moulded plastics tie bar 34 is employed, and this basically comprises a thin plate-like device, of approximately 3 millimeters thickness, which is adapted to lie in the mortar between two adjacent courses of bricks or blocks, forming the leaf of a wall. As is usual with tie bars, the bar 34 is formed with an outwardly splayed end 36 which is generally fan-shaped as seen in plan, there being a hole 38 formed through the tie bar in its outer end, partly for the purpose of reducing the quantity of material used in the construction of the tie bar, and partly as a means of providing an extra key into the mortar. It will be appreciated however, that the fan-shaped outer end 36 in itself provides a key into the plaster. At its inner end, the tie bar 34 has a root portion 40, which is adapted to be engaged in the dovetail-shaped recess 32 in the outside of the web 24 of the damp-proof course element 22. The root portion 40 is provided with a central cut-away portion 42, which enables the root to be compressed slightly in use, but the method of fitting the tie bar 34 in the dovetail-shaped recess 32, is to position the tie bar, so that its root portion is extending generally longitudinally of the recess 32, in which position, it is of course quite easy to push the root portion into the recess, and into contact with the base of that recess, and then to twist the tie bar about its own longitudinal axis, so that the pointed ends of its root portion 40, become engaged under the ribs 28 and 30. Once the tie bar occupies this orientation, where it extends at right angles to the web 24, it is held firmly in the dovetail-shaped recess 32, and cannot be detached from the element 22, by simply pulling the tie bar outwardly. In practice, fixing the tie bars into the recess 32, is a simple matter, of simply orientating the root portion of the tie bar so that it will pass between the ribs 28 and 30, and then twisting the tie bar, so that it snaps into engagement with the ribs 28 and 30.

The long web 26 of the element 22, has a somewhat zig-zag formation as seen in cross-section, so that it provides two inwardly facing dovetail cross-section recesses 44 and 46 with a land 48 between them, and a land 50 extending between the recess 46 and the inside face of the shorter web 24. Also, by virtue of its cross-sectional shape, the web 26 has a dovetail-shaped recess 52, which faces outwardly, and occupies a position opposite the land 48.

It is possible to fit tie bars into either of the dovetail-shaped recesses 44 and 46 of the web 26, and in the arrangement illustrated in FIG. 1, a tie bar 54, which is identical with the tie bar 34, is fitted into the outer recess 44, but because of the angular disposition of the webs 24 and 26, the tie bar 54 extends longitudinally of the cavity wall, whereas the tie bar 34 extends transversely of the wall.

A short extension 56 extends outwardly from the long web 26, and forms in effect a continuation of the web 24. An out-turned lip 58 is formed on the outer extremity of the extension 56, and there is an inclined rib 60 on the outside of the web 24, this rib 60 coinciding at its root, with the junction between the two webs 24 and 26. In the arrangement which is illustrated, the rib 60 is slightly longer than the ribs 28 and 30, although this is not an essential feature of the construction.

During the contruction of a cavity wall, when the wall has been built up to the height at which the window frame has to be fitted, a strip of the damp-proof course element 22 is cut to the length of the jamb 20 of the window frame, and this strip is then offered up to the outside edge face of the jamb, and located on the jamb, by the web 26, and the extension 56. The web 26 engages against the edge face of the window frame, and the extension 56 engages against the inside face of the window frame. Because the web 26 is of approximately 70 millimeters length, it will be observed, that when the element 22 is thus located on the window frame, the outer edge of the element 22 coincides with the outer face of the window frame itself. The element 22 is then secured to the window frame, by nails or screws 62, the heads of which are located in the recesses 44 and 46. It will be appreciated, that since the element 22 is made in plastics material, it is relatively easy to drive nails or screws through the web 26, but if desired, the element could have holes pre-drilled in it, for the reception of nails or screws.

The window frame, with the damp-proof course element 22 secured to it, is then placed in position on the cavity wall, and the outer edge of the rib 60 is located against the inside face of the internal leaf 12 of the cavity wall, whilst part of the land 48 on the web 26, is pressed against the end face 16 of the external leaf 10 of the cavity wall. It will be observed, that in this position, it is possible to fit wall ties such as 34 and 54, into the recesses 32 and 44, and that these wall ties will lie respectively within the internal and external leaves of the wall. The wall adjacent to the window frame is then built up in conventional manner, and where required, the wall ties 34 and 54, are fitted during construction of the wall, between courses of bricks or building blocks. Now since the recesses 32 and 44 extend throughout the length of the element 22, it will be appreciated, that the ties 34 and 54, can be fitted at any height, as and where they are required, according to the courses in the external and internal leaves of the wall. This is an important advantage of the damp-proof course construction, because it frequently happens, that the courses in the external and internal leaves are not aligned with each other, particularly where the external leaf is made of brickwork, and the internal leaf is made of breeze-blocks. Mortar is of course applied between the courses of building bricks or blocks, and some of the mortar squeezed out between the courses, will enter the undercut recesses 44 and 32, and will thereby assist in anchoring the damp-proof course 22, and hence the jamb 20 of the window frame, in position at the end of the cavity wall. Indeed, in some instances, it might be possible to avoid the use of the ties 34 and 54 altogether, since the engagement of the mortar in the undercut recesses 44 and 32, might be adequate for the purpose of securing the damp-proof course 22 and the window frame to the leaves of the wall. However, in general, it will be found advantageous to use the wall ties 34 and 54.

When the wall has been built up, and the mortar set, the jamb 20 will be very firmly anchored to the end of the cavity wall, and it will be observed, that there is a complete damp-proof barrier provided by the web 26, between the external leaf 10 of the wall, and the timber window frame jamb 20. This is an important advantage of the invention, because in practice, the external leaf 10 of the wall, is frequently damp for long periods of time. If the timber frame is in contact with the external leaf of the wall, then deterioration of the frame is almost inevitable, particularly in relatively wet climatic conditions. However, by providing the corrosion-resistant moisture impermeable damp-proof course between the external leaf 10 and the window frame 20, deterioration of the latter due to moisture travelling from the external leaf 10 into the jamb 20 is practically obviated. Furthermore, if there is any tendency for moisture to travel between the jamb 20 and the web 26 of the damp-proof element, by virtue of capillary action, then the presence of the undercut recess 52 acts as a moisture trap. A similar moisture trap is in fact provided by the undercut recess 64, which occurs between the extension piece 56, and the part of the web 26 which forms the recess 46.

A series of small shallow grooves 66 is formed along the length of the inside face of the shorter web 24, and since these grooves are closely juxtapositioned, there is formed a relatively sharp edge extending longitudinally of the strip, between each adjacent pair of grooves 66. This has been found to provide a most effective moisture barrier, preventing moisture travelling over the internal surface of the damp-proof course element 22. Now if moisture from the internal face of the external leaf 10 (and this internal face is frequently very wet in practice) attempts to cross the cavity 14, adjacent to the window frame, that moisture will first have to cross the barrier presented by the undercut recess 46. By virtue of the sharp longitudinally extending edges formed at the outside and inside edges of the recess 46, a most effective moisture barrier is provided, and it is unlikely that moisture in significant quantities will be able to bridge the recess 46, even allowing for the fact, that the moisture can to some extent travel diagonally across the internal face of the web 26, as the moisture runs down that internal face. However, the barrier provided by the grooves 66 on the inside face of the web 24 would also have to be traversed by the moisture, before it could arrive at the internal leaf 12 of the wall, and this is almost inconceivable. In practice, the construction of the element 22 effectively prevents moisture travelling from the external leaf to the inner leaf, even in unfavourable wind conditions.

It will be appreciated by those skilled in the art of building construction, that the closure of the end of the cavity 14 by the damp-proof course element 22 is much simpler than the conventional method of closing the cavity by bricks laid across the end of the cavity wall, since that conventional method of construction involves cutting half bricks, and also involves the fitting of a bitumen impregnated felt damp-proof course. Furthermore, since the element 22 is tied effectively to both internal and external leaves of the wall, those two leaves are held firmly together, at a position where the construction is often weak, due to the necessity to incorporate a damp-proof course between the two leaves of the wall.

The construction illustrated in FIG. 1, provides a pocket between the rib 60 and the lip 58, into which plaster or plasterboard 68 applied to the end face 18 of the internal leaf 12 can be fitted. This provides a very neat end to the plaster in the internal reveal of the window opening.

Turning now to FIG. 2, there is illustrated a cavity wall, having an external leaf 70 and an internal leaf 72, with a cavity 74 between them. In this construction however, the cavity 74 has a width of 63 millimeters, which is a standard cavity width, approved in the United Kingdom, but not so often used as the 50 millimeters cavity width illustrated in FIG. 1. Nevertheless, the damp-proof course element 22 can be used to mount a standard 70 millimeters thick window frame 76 at the end of the cavity wall, as is illustrated in FIG. 2. The element 22 is identical with that illustrated in FIG. 1, and it is secured to the jamb 76 of the window frame, in exactly the same manner as has been described with reference to FIG. 1. However, during construction of the wall, the full length of the longer web 26 is offered up to the end face 78 of the external leaf 70, with the inside face of the shorter web 24 in engagement with the inside face of the external leaf 70. In other words, the element 22 is located entirely on the external leaf of the wall, using the right-angle arrangement of the webs 26 and 24, as a means of obtaining the location. As a result of this, the jamb 76 is positioned entirely on the external leaf of the wall, and although this may not be such a good position as that illustrated in FIG. 1, from the point of view of protecting the window frame from the elements, it is a position much favoured by the building trade, because it reduces the width of the head and sill required for fitting to the window frame opening.

Wall ties 34 and 54 are fitted exactly as previously described with reference to FIG. 1, excepting that the ties 34 are required to extend across the width of the cavity, and to have their outer ends engaged in the internal leaf 72 of the wall.

Now it will be observed, that since the element 22 is located entirely against the external leaf of the wall, the end of the cavity 74 remains open during construction of the wall, and indeed it is possible to leave this end of the cavity open for some time after the wall has been constructed, before any plaster is applied to the internal reveal of the window frame opening. This is an advantage, because it permits of quicker drying out of the mortar inside the cavity 74.

A plasterboard 80 (preferably foil backed) is fitted across the end face 82 of the internal leaf 72, and this board 80 also extends across the end of the cavity 74, and is received in the pocket provided between the lip 58 and the rib 60. Prior to fitting the plasterboard 80, nails or screws 84 may be driven through the extension piece 56 of the element 22, into the jamb 76, for the purpose of ensuring that the extension 56 is firmly located against the internal face of the jamb 76. The board 80 will be pressed as far as possible into the pocket formed between the lip 58 and the rib 60, and since the pocket tapers in width, due to the inclination of the rib 60, it is possible to accommodate a range of thicknesses within this pocket. Once the plasterboard has been received in the pocket, it is secured to the internal leaf of the wall in the conventional manner, and after fitting of the board, it will be skimmed as is usual to provide a smooth internal reveal surface.

With the construction illustrated in FIG. 2, there is the damp-proof course between the external leaf 70 and the jamb 76, and there is also a damp-proof course provided by the web 24, separating the two leaves of the cavity wall. It will be appreciated, that it is extremely difficult for moisture to travel between the external leaf 70 and the web 24, owing to the grooves 66, and if moisture does succeed in arriving on the outside face of the web 24, then it still has to cross the moisture barrier provided by the lips 28 and 30, and the recess 32 between them, and then it has to negotiate the rib 60, before it could arrive at the interior of the plasterboard 80. Even then, if that plasterboard is foil backed, it could not penetrate the board itself, but would have to travel across the back of the plasterboard before it could arrive at the internal leaf 72. Once again therefore, a moisture barrier is effectively provided between the internal and external leaves of the wall.

Turning now to FIG. 3, there is illustrated a cavity wall construction comprising an external leaf 90 and an internal leaf 92, with a cavity 94 between them, this cavity being also of 63 millimeters width. Again, there is a jamb 96 of a window frame, and the element 22 is secured to the jamb 96, in exactly the same manner as described with reference to FIG. 1. In this construction however, when the window frame is being fitted, only the outer edge portion of the web 26 is in engagement with the end face 98 of the external leaf 90 of the wall, and the rib 60 locates against the face 100 of the internal leaf 92, which is in the cavity 94. In fact, the location against the internal leaf 92, is exactly the same as that illustrated in FIG. 1, and the only difference is that owing to the increased width of the cavity, the window frame does not extend so far forwardly on to the external leaf 90. Tie bars 34 are secured in the recess 32, and anchor the element 22 to the internal leaf, but for securing the element 22 to the external leaf 90, tie bars 102 are employed, which are of slightly different construction to those illustrated at 34 and 54. Essentially, the tie bars 102 are flat plate-like elements, having outer end formations 104 similar to the outer end formations 36 on the tie bars 34, and they also have root formations 106 adapted to be anchored in the recess 44, but the root portion 106 is at an angle to the main part of the tie bar 102, so that when the root portion is engaged in the recess 44, the tie bar extends at an acute angle to the web 26, as illustrated in FIG. 3. This enables the tie bars 102 to be received almost completely in the external leaf 90 of the cavity wall, despite the fact that the recess 44 is partly aligned with the end face 98, and partly extends into the cavity 94.

It will be appreciated, that the damp-proof course element 22 when fitted as shown in FIG. 3, offers exactly the same functions and advantages as have been described, with reference to FIG. 1 of the drawings.

FIG. 4 illustrates an arrangement, in which there is a cavity wall comprising an external leaf 110 and an internal leaf 112, with a cavity 114 between them, but in this instance, the cavity 114 is of 76 millimeters width, which is the maximum width of cavity normally employed in the United Kingdom. The jamb 116 of a standard 70 millimeters thick window frame is also shown in FIG. 4, and this occupies a position aligned with the external leaf 110 of the wall, similar to that which is illustrated in FIG. 2. A damp-proof course strip element 22 identical with that described with reference to FIG. 1 is employed, and it is positioned on the external leaf of the wall, in the same location as that described with reference to FIG. 2. Tie bars 54 anchored in the recess 44 engage in the external leaf 110, but for tying the damp-proof course element to the internal leaf 112, special elongated tie bars 118 are employed, which are long enough to be anchored at their root ends in the recess 32, and at the same time to have their fan-shaped outer ends 120 engaged in the inner leaf 112. Foil backed plasterboard 122 is employed to cover the internal reveal of the window opening, and to bridge the cavity 114, as has been described with reference to FIG. 2, although it will be appreciated, that the plasterboard has to extend across a greater width in the arrangement shown in FIG. 4 than in the FIG. 2 arrangement.

FIG. 5 also illustrates a wall having an external leaf 130 and an internal leaf 132, with a 76 millimeters wide cavity 134 between them. In this construction, a standard 70 millimeters thick window frame, the jamb 136 of which is illustrated, is located in a central position, where it bridged the end of the cavity 134, and the damp-proof course element 22 is used in similar manner to that described with reference to FIG. 3, excepting that the outer end of the web 26 only just engages on the end of the external leaf 130, and there is a narrow gap between the rib 60 and the internal leaf 132. Tie bars 34 are fitted into the recess 32, and tie bars 102 are fitted into the recess 44. Plaster or plasterboard 138 is used to cover the end of the internal leaf 132, this plaster or plasterboard being received in the pocket formed between the rib 60 and the lip 58.

Sometimes window openings are formed with a so-called "checked" reveal, and a wall of this construction, is illustrated in FIG. 6, wherein there is an external leaf 140 and an internal leaf 142, with a standard 50 millimeters wide cavity 144 between them, but in this construction, it will be observed that the end 146 of the external leaf 140 is not in alignment with the end 148 of the internal leaf 142, and that the external leaf projects beyond the internal leaf, leaving a so-called "checked" reveal on the inside of the external leaf.

A standard 70 millimeters thick window frame is employed, the jamb 150 being illustrated in FIG. 6, and the window frame is located, so that it bridges the end of the cavity 144, and extends over part of the end face 148 of the internal leaf 142. This is a very good position for the window frame, in that it is well protected from external elements.

The damp-proof course element 22 is again employed, and in this arrangement, the web 26 which is secured to the timber jamb 150 as previously described, partially engages with the end face 148 of the internal leaf 142. The web 24 extends into the cavity 144, but in this construction, the rib 60 engages with the inside face of the external leaf 140, and by virtue of the location of the land 48 on the end face 148 of the internal leaf, the lip 58 is aligned with the end face 146 of the external leaf 140.

Wall ties 34 and 54 are fitted respectively into the recesses 44 and 32, and it will be observed that in this arrangement the element 22 is oriented with respect to the wall, so that the recess 32 in the outside of the web 24 faces outwardly. In all the arrangements described with reference to FIGS. 1 to 5, the recess 32 has been facing inwardly, and FIG. 6 illustrates the versatility of the damp-proof course element, in that it can also be used in the opposite orientation to that illustrated in FIGS. 1 to 5.

During the construction of the external leaf of the wall, mortar squeezed out from between adjacent courses of bricks will enter the pocket formed between the rib 60 and the lip 58, and this will assist in locating the corner of the element 22. It will be appreciated of course, that the ribs 28 and 30, which define the recess 32, and the grooves 66 provide the usual moisture barrier, preventing moisture from travelling from the external leaf to the internal leaf of the wall. In other respects, the damp-proof course element 22 functions as previously described.

Turning now to FIG. 7, there is illustrated a wall having an external leaf 160 and an internal leaf 162, with a standard 50 millimeters wide cavity 164 between them. In this arrangement, however, the internal leaf 162 projects beyond the end of the external leaf 160, so that an external "checked" reveal is formed as distinct from the internal "checked" reveal which is illustrated in FIG. 6. A standard 70 millimeters thick window frame jamb 166 is shown in a position where part of it is in line with part of the external leaf 160, and part of if extends across the end of the cavity 164. In fact, the location of the window frame is very similar to that shown in FIG. 1. The damp-proof course element 22 is again used, in somewhat similar manner to that illustrated in FIG. 1, excepting that the lip 58 is aligned with the end of the internal leaf 162, thereby aligning the element 22 with the internal leaf 162, in rather similar manner to that in which the element 22 is aligned with the external leaf 140 in FIG. 6.

Now it will be appreciated, that although in the arrangements so far described, the window frame has always been of 70 millimeters thickness, timber window frames are sometimes made in other thicknesses. The jamb 170 of a window frame of 82 millimeters thickness, is illustrated in FIG. 8, entirely aligned with an external leaf 172 of a cavity wall, which also includes an internal leaf 174 spaced from the external leaf to provide a standard 50 millimeters wide cavity 176. The damp-proof course element 22 is fitted as described with reference to FIG. 2, but the web 26 stops some 12 millimeters short of the outer face of the jamb 170, leaving a recess 178 between the jamb 170 and the end face of the outer leaf 172. This recess is not detrimental to the construction, and can in any event be filled with mastic. However, FIG. 8 illustrates an additional gap closing element 180, which can be used in situations similar to that shown in FIG. 8, where there would be a recess visible either externally or internally, between an end face of the jamb 170, and a corresponding end face of the wall.

The gap closing element 180 is made as a plastics extrusion in similar material to that employed for the damp-proof course element 22, and indeed one convenient method of manufacturing the gap closing element, is to form it alongside the damp-proof course element 22, the two elements being connected together during formation by a sprue which can be cut off, to separate the gap closing element 180 from the damp-proof course element 22.

The gap closing element 180 simply comprises a flat strip portion 182 and a thickened end portion 184, which tapers to a feather edge. The strip portion 182 is nailed (not shown) to the jamb 170 before the window frame is offered up to the building structure, and the width of the end portion 184, equals the thickness of the web 26 of the element 22, so that when the wall is built up, the feather edge of the gap closing element 180 engages with the end face of the external leaf 172, thereby providing a complete closure of the recess 178.

In FIG. 9, there is illustrated another arrangement, in which there is an external leaf 190, an internal leaf 192 with a standard 50 millimeters wide cavity 194 between them, and the jamb 196 of a window frame is located so that its inner face 198 is about halfway across the width of the cavity 194, and part of the jamb 196 is aligned with the end of the outer leaf 190. This is a very popular position for the window frame relatively to the wall. A damp-proof course element 200 is employed, which is almost identical with the element 22 (and therefore the same reference numerals will be used for identical parts) but there is an extension piece 202 similar to the extension piece 56, but of slightly greater width, and instead of the lip 58, there is a curved lip 204 the end face 206 of which occupies the position which would be occupied by the inside face of the lip 58. Externally, the lip 204 presents the appearance of a quadrant moulding, and therefore when plasterboard 208 is pressed into the pocket formed between the end face 206 of the lip 204 and the rib 60, the lip 204 provides a neat finishing strip, having the external appearance of quadrant mouldings as frequently used in the corners of building constructions.

In other respects, the damp-proof course element 200 acts in the same manner as the damp-proof course element 22, although in the construction illustrated in FIG. 9, the web 24 occupies a central position in the cavity 194, where it is not in contact with either of the leaves 190 and 192 of the wall.

FIG. 10 illustrates another arrangement, in which a cavity wall has an external leaf 210 and an internal leaf 212, with a standard 50 millimeters wide cavity 214. The jamb 216 of a 70 millimeters thick window frame is positioned in alignment with the external leaf 210 of the wall, and the arrangement is almost identical with that shown in FIG. 2 of the drawings, excepting that a damp-proof course element 200 is employed, thereby presenting the quadrant finishing strip 204, between the inside of the jamb 216, and a plasterboard 218 applied to the internal reveal of the window opening.

Another aspect of the invention is illustrated in FIG. 11, wherein there is shown a cavity wall comprising an outer leaf 220 and an inner leaf 222, with a 50 millimeters wide cavity 224 between them. In this construction, the end faces 226 and 228 of the external and internal leaves are in alignment with each other, and there is illustrated the jamb 230 of a timber window frame, located in a position where it is substantially in alignment with the external leaf 220 of the wall.

In this arrangement, a damp-proof course element 232 is employed, which is manufactured by a plastics extrusion process in a plastics material such as polyvinylchloride in similar fashion to that described for the manufacture of the damp-proof course element 22.

However, it will be observed from FIG. 11, that the cross-sectional shape of the element 232, is quite different to that of the element 22. There are webs 234 and 236, which are intended to engage with the jamb of the window frame, and to enter the cavity as will hereinafter be described, but whereas the webs 24 and 26 are disposed at right angles to each other, the webs 234 and 236 are disposed at an acute angle, in this particular instance about 72°. There is a short extension piece 238 projecting from the junction between the webs 234 and 236, and a right angled rebate 240 is formed in the extension 238, to provide an outer location, for locating the element 232 on the corner of a leaf of the wall. In FIG. 11, the outer location 240 is shown engaging on the corner at the junction of the end face 228 and the inside face 242 of the internal leaf 222.

The web 234 is somewhat shorter than the web 236, and it is formed with an inwardly facing recess 244, and two outwardly facing recesses 246 and 248 which are similar to the dovetail-shaped recesses 44 and 32 referred to with reference to FIG. 1 of the drawings. These recesses 244, 246 and 248 are therefore adapted to receive the roots of wall ties such as that illustrated at 54, engaging in the recess 244 and extending into the external leaf 220 of the wall.

In addition, a corner recess 250 is formed in the web 234 adjacent to the joint between the two webs, this recess 250 being deeper than the recesses 246 and 248, and in addition to its dovetail cross-sectional shape, there are provided outwardly angled walls 252 and 254 which are adapted to abut against correspondingly angled edges 256 and 258 formed on the tie bars, where the main portion of the tie bar narrows to form the root portion for anchoring in the dovetail-shaped recesses. Hence, if the root of a tie bar is anchored in the deep recess 250, it is very firmly located therein, because in addition to its engagement with the converging edges of the dovetail recess, it also engages on the diverging edges 252 and 254.

On the inside of the web 234, there is an upstanding location rib 260, formed on both its opposed faces, with grooves 262 similar to the grooves 66 described with reference to FIG. 1 of the drawings, for the purpose of providing moisture barriers on both sides of the location rib 260. The distance between the face of the outside location 240 which is parallel with the side faces of the location rib 260 and the outer face of that location rib, is approximately 50 millimeters, so that with the outer location 240 engaged with the inside of the inner leaf 222 as illustrated in FIG. 11, the location rib 262 engages with the inside face of the external leaf 220, and thereby locations are provided, for building up the internal and external leaves of the wall, for respect to the damp-proof course element 232. In addition, a marking groove 264 extends along the length of the web 234, and the distance beteen the outer location 240 and the marking groove 264 is approximately 63 millimeters, corresponding to the width of a popular size of cavity.

The web 236 is formed with a dovetail cross-section recess 266 near to its outer end, this recess facing inwardly, and there are three outwardly facing recesses 268, 270 and 272. In addition, there is a deep recess 274 at the end of the web 236 where it joins the web 234, and this recess 274 is similar to the deep recess 250 previously described. If a tie bar 34 is fitted in the deep recess 274 as illustrated, then that tie bar will extend into the internal leaf of the wall, at an angle determined by the angle of inclination of the web 236 with respect to the web 234.

Assuming that the element 232 is used in the orientation and location illustrated in FIG. 11, with the longer web 236 entering the cavity, then it will be observed, that although the outer location 240 locates on the inside face of the internal leaf 222, the outer extremity of the web 236 does not touch the inner face of the external leaf of the wall. This is because the distance between the face of the outer location 240 which engages against the face 242 of the internal leaf, and the point marked "X", which is the point of intersection of a line "Y" drawn from the extremity of the web 236 perpendicular to the web 234, and the web 234 itself, is less than 50 millimeters. This is a significant feature of the construction, because it ensures, that even when the longer web 236 enters the cavity, it does not completely bridge the cavity. Hence, with the damp-proof course element in the position shown in FIG. 11, there is an excellent damp-proof barrier between the inner and outer leaves of the wall provided by the web 236.

A bracing strut 276 extends across the corner between the webs 234 and 236, joining those webs on the outsides of the deep recesses 250 and 274. This strut 276 considerably strengthens the element 232, and in addition, it is formed with a series of shallow grooves 278 similar to the grooves 66, for the purpose of providing an additional moisture barrier.

A location rib 280 very similar in construction to the rib 260, is formed on the inside of the web 236, and it is positioned so that its outer face is approximately 50 millimeters from the face of the outer location 240, which is shown engaging with the end face 228 of the inner leaf 222 in FIG. 11. As will hereinafter appear, this location rib 280 can be used in similar fashion to locate against the external or internal leaf of a wall, when the element 232 is used in an orientation, wherein the shorter web 234 is located within the cavity. In addition, there are longitudinally extending marking grooves 282 and 284 on the inside face of the longer web 236, positioned respectively at 63 millimeters and 76 millimeters from the face of the outer location which is shown engaging with the end face 228.

When the wall is being constructed, the damp-proof course element 232 is secured to the jamb 230 by means of nails or screws, as previously described with reference to the element 22. For the purpose of locating the jamb 230 along the length of the web 234, a special and separate end location element 286 is provided, this element being also formed as a plastics extrusion of constant cross-section throughout its length, in similar fashion to the method of manufacture used for the element 232 itself. Indeed, as with the gap closing element 180, the end location element 286 can also be formed at the same time as the element 232, being joined thereto by a sprue, which can be broken off on site. Alternatively of course, the location element 286 may be separately formed, and strictly speaking this element could be made in material other than plastics material.

Essentially, the location element 286 has a root portion 288 which is similar to the root portions provided on the tie bars 34 and 54, so that the location element can be slid endwise into one of the dovetail cross-section recesses formed in the webs of the damp-proof course element 232. It is a significant feature of the location element, that it can be orientated in two ways relatively to the web in which it is secured. Externally of the web, the location element presents two abutments 290 and 292, but these are differently spaced from the longitudinal centre line of the root portion 288 of the element 286. Thus, with the end location element positioned as shown in FIG. 11, the abutment 290 provides a location for the inner face of the jamb 230, but it will be appreciated, that if the element 286 were withdrawn from the recess 248 and then reinserted in the opposite orientation, so that the abutment 292 faced the jamb 230, then the jamb would have to be moved inwardly of the wall—by a distance of 3 millimeters in this particular construction—in order to contact the abutment 292. Therefore, the end location element 286 always provides two alternative internal locations for the window frame jamb, for each of the dovetail-shaped recesses, in which it can be employed. As shown in FIG. 11, the abutment 290 is operative, and the inner face of the jamb 230 just projects beyond the inside face of the external leaf of the wall.

A plaster groove 294 is formed in the extension piece 238, and there is an undercut 296 in the location element 286. During plastering of the internal reveal of the window opening, a hessian scrim 298 is pressed into an initial plaster skim on the end face 228 of the internal leaf 222, and carried over the extension 238, and into the undercut 296 of the element 286. During application of the plaster, the plasterer runs his trowel over the scrim 298, pressing it into the groove 294, so that it becomes anchored in that groove, by the plaster which follows it into the groove. Similarly, the end of the scrim is pressed into the undercut 296, and become anchored therein by the additional plaster which is applied. In this way, a very effective key is provided for the plaster on the inside of the reveal.

It will be appreciated, that the damp-proof course element 232 functions generally as described with reference to the element 22, in that it provides a damp-proof barrier between the outer leaf 220 of the brickwork and the window frame itself, it also provides a damp-proof barrier between the inner and outer leaves of the wall, and by virtue of the ties 34 and 54, it provides means for tying the two leaves of the wall together adjacent to the window opening.

The damp-proof course element 232 is rendered particularly versatile, because of the unequal length of the webs 234 and 236, the arrangement of the undercut recesses 244, 246, 248, 250, 266, 268, 270, 272 and 274 and the provision of the end location element 286 with its alternative orientations. A few of the ways in which the element 232 can be employed are illustrated in FIGS. 12 to 17, and these will be only briefly described, since the element itself is the same in all these drawings, and it is only the manner of its use which is changed.

Referring to FIG. 12, there is shown a cavity wall comrising an external leaf 300 and internal leaf 302 and a cavity 304 of 50 millimeters width between them. A 70 millimeters thick window frame jamb 306 is shown in a position where it is quite close to the outer face of the external leaf 300, a position which is perhaps not entirely desirable, but which is quite often used, because it reduces the width of the sill very considerably. In order to provide for this positioning of the window frame, the damp-proof course element 232 is used, with the longer web 236 extending along the end face of the wall, including a portion extending between the outer leaf 300 and the jamb 306, and the shorter web 234 entering the cavity, the outer location 340 engaging on the corner of the internal leaf 302. The location rib 280 of the longer web 236 is engaged against the inside face of the external leaf 300 of the wall, so that the two leaves of the wall are correctly aligned with the damp-proof course element, by virtue of the outer location 240 and the location rib 280. The end location element 286 is fitted in the dovetail-shaped recess 270 of the web 236 (that is the middle recess of the three identical recesses formed in the outer face of the longer web 236) with its abutment 290 engaging with the internal face of the jamb 306. This represents the outermost practicable location of the window frame in association with the damp-proof course element 232. It will be understood, that by simply reversing the position of the element 286 in the recess 270, it would be possible to pull the window frame another 3 millimeters into the window opening, and that if the element 286 were fitted into the recess 272, then the window frame would be located even further inwardly of the window opening. This arrangement is in fact illustrated in FIG. 13, which is similar in all other respects to FIG. 12, and for this reason the same reference numerals have been used. FIG. 14 shows the arrangement just referred to, in which the damp-proof course element 232 is itself in the same position as illustrated in FIG. 12, but the element 286 is in the opposite orientation to that shown in FIG. 12, so that the window frame is moved slightly inwardly from the position illustrated in FIG. 12.

FIG. 15 shows quite a different arrangement, in which there is a cavity wall comprising an outer leaf 310, an inner leaf 312 with a cavity 314 between them, and a 70 milimeters thick window frame jamb 316 is positioned so that it bridges the end of the cavity 314. This of course is a position considerably to the inside of any of the positions illustrated in FIGS. 12 to 14. For this location, the damp-proof course element 232 is used, with the shorter web 234 engaging between the jamb 316 and the end of the wall, and with the longer web 236 entering the cavity. However, in this arrangement, the outer location 240 is engaged on the inner corner of the external leaf 310 of the wall, so that the web 234 projects inwardly from that position, and the web 236 is inclined inwardly away from the end of the wall. The location rib 260 engages against the inner face of the internal leaf 312, so that the arrangement can be considered as being the reverse of that illustrated in FIG. 11. Ties 34 and 54 are used for securing the element 232 in the inner and outer leaves of the wall as previously described, excepting that because of the disposition of the element 232, the tie 34 which extends perpendicular to the web 234 is in the inner leaf of the wall, and the tie 54 which is inclined because of the inclination of the web 236, extends into the external leaf 310. The location element 286 is employed in the recess 246, with the abutment 290 engaging against the side face of the jamb 316, but it will be appreciated, that the element 286 could be positioned in the recess 246 in the opposite orientation, so that its abutment 292 would engage with the jamb 316, thereby permitting the window frame to lie a further 3 millimeters into the window opening.

FIG. 16 shows another arrangement, in which a wall comprises an external leaf 320 and a internal leaf 322, with a 50 millimeters wide cavity 324 between them. In this arrangement, a 70 millimeters thick window frame jamb 326 is positioned so that it bridges the end of the cavity 324, and for this position, the damp-proof course element 232 is used with its longer web 236 engaged against the end of the inner leaf 322, the outer location 240 locating on the inner corner of the external leaf 320 and the shorter web 234 extending into the cavity. The location element 286 is positioned in the recess 270 of the web 236.

In all the arrangements which have been illustrated, the damp-proof course element which is essential to the invention has been employed in a vertical position, between the jamb of a window or door frame and the end of the cavity wall. It is to be understood however, that the damp-proof course element can also be used under the sill of a window, or across the head of a window or door frame. This is illustrated in FIG. 17, where there is shown part of a cavity wall comprising an external leaf 330 and an internal leaf 332, with a 50 millimeters wide cavity 334 between them. The sill 336 of a window frame is illustrated lying across the top of the external leaf 330, and projecting on the outside of that leaf. In this arrangement, the damp-proof course element 232 is employed with the longer web 236 lying in a horizontal position resting on the top surface of the external leaf 330, and underneath the sill 336. The outer location 240 engages on the inner corner of the inner leaf 332, and the shorter web 234 projects downwardly into the cavity 334. The location rib 260 rests against the inside face of the external leaf 330, and the detail is quite similar to that illustrated in FIG. 12, expecting that the element 232 occupies a horizontal position, rather than a vertical position. The usual mortar bed 338 is applied to the top of the internal leaf 332, and part of this bed is supported on the web 236, where that web extends across the top of the cavity 334. Finally, the usual tiles 340 or window board is or are applied to the top of the mortar bed 338, the outer edge of the tiles or window board being received in a groove 342 provided in the inner face of the sill 336. It will be appreciated, that different window position can be accommodated by varying the location of the damp-proof course element 232 under the sill, and across the top of the wall beneath the window opening, in similar fashion to the variations described with reference to FIGS. 11 to 16.

It will be noted that there is a considerable recess between the outside edge of the web 236 and the external face of the external leaf 330. This can be closed by mastic pointing 346 or by use of the gap closing element 180.

The following schedule indicates the manner in which the damp-proof course element 232 can be used to provide window or door frame fixing positions in cavities 50 millimeters 63 millimeters or 76 millimeters wide, with reveal depths (that is the depth from the outer face of the external leaf of the wall to the outer face of the frame) varying from 9 millimeters to 95 millimeters.

SCHEDULE OF FRAME FIXING POSITIONS

| Cavity width mm. | Reveal depth mm. | Long web 236 in cavity. | Short Web 234 in cavity. | Location 240 to outside leaf. | Location 240 to inside leaf. | Recess used for element 286. | Abutment 290 to frame. | Abutment 292 to plaster. | Recess for external leaf tie. | Recess for internal leaf tie. |
|---|---|---|---|---|---|---|---|---|---|---|
| 50 | 9 | | X | | X | 270 | X | | 266 | 250 |
| " | 19 | | X | | X | 270 | | X | 266 | 250 |
| " | 32 | X | | | X | 248 | X | | 244 | 274 |
| " | 41 | X | | | X | 248 | | X | 244 | 274 |
| " | 54 | X | | | X | 250 | X | | 244 | 274 |
| " | 82 | X | | X | | 246 | X | | 274 | 244 |
| " | 86 | | X | X | | 270 | X | | 250 | 266 |
| " | 92 | X | | X | | 246 | | X | 274 | 244 |
| " | 95 | | X | X | | 270 | | X | 250 | 266 |
| 63 | 22 | | X | | X | 270 | X | | 266 | 250 |
| " | 32 | | X | | X | 270 | | X | 266 | 250 |
| " | 44 | X | | | X | 248 | X | | 244 | 274 |
| " | 54 | X | | | X | 248 | | X | 244 | 274 |
| " | 66 | X | | | X | 250 | X | | 244 | 274 |
| " | 82 | X | | X | | 246 | X | | 274 | 244 |
| " | 86 | | X | X | | 270 | X | | 250 | 266 |
| " | 92 | X | | X | | 246 | | X | 274 | 244 |
| " | 95 | | X | X | | 270 | | X | 250 | 266 |
| 76 | 35 | | X | | X | 270 | X | | 266 | 250 |
| " | 44 | | X | | X | 270 | | X | 266 | 250 |
| " | 86 | | X | X | | 270 | X | | 250 | 266 |
| " | 95 | | X | X | | 270 | | X | 250 | 266 |

I claim:

1. A damp-proof course for use at the end of a cavity wall of a building structure which abuts the frame of a door or window, comprising a strip of corrosion-resistant, moisture impermeable material having a constant cross-section throughout its length, and providing two web-like elements arranged at an acute angle in the range 45° to less than 90° with respect to each other, whereby each of said web-like elements has an inside face and an outside face, each of said two webs having at least one undercut formation on its inside face and at least one undercut formation on its outside face, each of said undercut formations being identical in cross-section and providing anchorage for wall ties at any position along the length of the strip, at least one of said webs also having a moisture barrier formation on its inside and extending throughout the length of said strip.

2. A damp-proof course according to claim 1, wherein one of said webs is longer than the other, as seen in cross-section of said strip.

3. A damp-proof course according to claim 2, wherein there is a larger number of undercut formations on said longer web than on said shorter web.

4. A damp-proof course according to claim 3, wherein each said undercut formation takes the form of an undercut recess of dovetail-shaped cross-section.

5. A damp-proof course according to claim 1, wherein there is a socket formation on the outside of the angle formed by said webs, said socket receiving the end of a board which extends generally in the same direction as one of said webs.

6. A damp-proof course according to claim 5, wherein said socket formation has an inwardly tapered cross-section, whereby boards of different thicknesses can be engaged in it, and will penetrate said socket to depths related to the thickness of the board.

7. A damp-proof course according to claim 1, wherein said moisture barrier formation comprises means defining at least one sharp edge extending throughout the length of said strip.

8. A damp-proof course according to claim 7, wherein said moisture barrier formation comprises a plurality of shallow grooves in close juxtaposition to each other.

9. A damp-proof course according to claim 1, wherein said two webs are disposed at an acute angle less than a right angle with respect to each other, as seen in cross-section of said strip, an external corner location is formed at the junction of said two webs whereby said strip can be located on a corner of one of the leaves of a cavity wall, and the arrangement of said webs is such that the point of intersection of a projection of the outer end of either web along a perpendicular to the other web and that other web is less than 50 millimeters from said corner location.

10. A damp-proof course according to claim 9, wherein at least one of said webs is provided with an inwardly projecting location rib spaced from said corner location by a distance such that with said external corner location located on the inside corner of one leaf of a cavity wall, said location rib will rest against the inside of the other leaf of the cavity wall.

11. A damp-proof course according to claim 9, wherein said location rib is formed with a moisture barrier such as a plurality of closely juxtapositioned grooves, in at least one of its faces.

12. A damp-proof course according to claim 1, wherein a diagonal strut extends between said two webs to provide a brace against closure of the angle between said webs.

13. A kit for use in building construction, comprising a damp-proof course strip according to claim 1, and a stop element in the form of a strip of constant cross-section throughout its length, the cross-section shape of said stop element providing it with a formation such that it can be located in an undercut formation in said damp-proof course strip in either of two orientations, and said stop element has a shoulder portion, which exhibits two oppositely facing abutments external to said damp-proof course strip when said stop element is in position on said damp-proof course strip, said shoulder portion being so arranged that said oppositely facing abutments occupy alternative locations relatively to said damp-proof course strip in the alternative orientations of said stop element.

14. A kit for use in building construction, comprising a damp-proof course for use at the end of a cavity wall of a building structure which abuts the frame of a door or window, comprising a strip of corrosion-resistant, moisture impermeable material having a constant cross-section throughout its length, and providing two web-like elements arranged at an acute angle in the range 45° to 90° with respect to each other, whereby each of said web-like elements has an inside face and an outside face, each of said two webs having at least one undercut formation on its inside face and at least one undercut formation on its outside face, each of said undercut formations providing anchorage for wall ties at any position along the length of the strip, at least one of said webs also having a moisture barrier formation on its inside and extending throughout the length of said strip, and a stop element in the form of a strip of constant cross-section throughout its length, the cross-section shape of said stop element providing it with a formation such that it can be located in an undercut formation in said damp-proof course strip in either of two orientations, said stop element having a shoulder portion, which exhibits two oppositely facing abutments external to said damp-proof course strip when said stop element is in position on said damp-proof course strip, said shoulder portion being so arranged that said oppositely facing abutments occupy alternative locations relative to said damp-proof course strip in the alternative orientations of said stop element.

* * * * *